United States Patent [19]

Newman et al.

[11] 4,131,067

[45] Dec. 26, 1978

[54] SPIKE DRIVER

[75] Inventors: George R. Newman, Lexington; Raymond R. Lund, West Columbia, both of S.C.

[73] Assignee: Canron Railgroup, West Columbia, S.C.

[21] Appl. No.: 779,633

[22] Filed: Mar. 21, 1977

[51] Int. Cl.[2] ..... E01B 29/26

[52] U.S. Cl. ..... 104/17 R; 198/396; 221/156; 221/226; 221/236; 227/6

[58] Field of Search ..... 104/17 R, 17 A, 1 R, 104/2, 5, 6, 16; 227/2, 3, 4, 5, 6; 198/381, 396, 690; 221/156, 212, 226, 236, 254; 214/17 CA; 73/105; 33/1 Q

[56] References Cited

U.S. PATENT DOCUMENTS

| | | | |
|---|---|---|---|
| 719,217 | 1/1903 | Hewitt | 104/6 |
| 3,127,000 | 3/1964 | Tack | 198/396 X |
| 3,330,220 | 7/1967 | Stewart et al. | 104/17 R |
| 3,426,698 | 2/1969 | Foxx et al. | 104/17 R |
| 3,753,404 | 8/1973 | Bryan, Jr. | 104/17 R |
| 3,753,405 | 8/1973 | Bryan, Jr. | 104/17 R |
| 4,006,812 | 2/1977 | Everett et al. | 198/396 X |

*Primary Examiner*—Albert J. Makay
*Assistant Examiner*—Randolph A. Reese

[57] ABSTRACT

A spike driving machine is disclosed in which a hole sensing device and spike holder are driven in toward a rail under the action of a fixed stroke piston and cylinder until a stop engages the rail. The stop has been previously adjusted to line up the hole sensing device and spike holder the correct lateral distance for engagement with the tie plate holes. Excess travel of the piston and cylinder is taken up by providing a flexible connection between an X-frame carrying the hole sensing device, the spike holder and a drive head and a Y-frame which is fixed in the lateral direction. The stroke is chosen to align the spike holder under the drive head. Thus, the arrangement can be used for rails of differing thickness simply by adjusting the stop appropriately.

20 Claims, 16 Drawing Figures

SPIKE DRIVER

BACKGROUND OF THE INVENTION

This invention relates to an automatic spike driver for driving spikes through holes in rail tie plates to secure rails to rail ties.

A tie plate is a channelled plate which rests on a wooden tie and which receives a rail. The tie plate has two holes on each side but normally spikes are driven through only one hole on each side into the tie, the head of the spike bearing against or being slightly spaced from the rail to ensure the rail, tie plate and tie are all secured together. A problem in driving the spikes automatically is that the holes must be accurately located automatically and a spike setter and driver head positioned so that the spikes can be driven accurately through the holes. Another problem is that the spikes have to be conveyed to the drive head in the correct orientation with respect to the rail.

U.S. Pat. No. 3,753,404 to Bryan discloses a spike driver in which rail locators are swung inwardly by an operating cylinder until they engage the rail and these establish a reference for the holes in the tie plate in the X-direction, i.e., in the direction laterally of the rails. The Bryan device then sweeps in the Y direction, i.e., along the rail until a hole is detected at which point a spike is driven by a drive head through the hole into the tie.

One problem with the prior device is that it is not easy to envisage how the device would cope with different thicknesses of rails as there is no disclosure as to what causes the operating cylinder to stop extending and one must assume that the piston continues to the end of its stroke.

Moreover the angle at which a spike is driven would vary with different thicknesses of rail thus limiting the use of the prior machine.

Another problem of the earlier device is that it uses a flexible tube system to convey spikes from a hopper directly to the drive head and so the geometry of this guide tube changes according to the distance the drive head moves in the X and Y directions. Such a variable geometry arrangement is likely, in practice, to give rise to spike feed, and particularly, spike orientation problems.

SUMMARY OF THE INVENTION

The above mentioned problems are obviated or mitigated by the present invention in which spikes are received at a fixed location in a spike setter and transferred laterally to a drive head the position of which will vary according to rail thickness using a mechanism which ensures that under all circumstances the spike is set exactly under the drive head and the spike setter, hole feeler and spike head are positioned the correct distance from the rail to align with the plate holes.

Thus, according to a broad aspect, the present invention provides in a spike driving system for driving spikes through holes in rail tie plates to secure rails to ties, a hole locating mechanism comprising a first member carrying a hole sensing device, means for moving the hole sensing device laterally towards a rail a fixed distance, stop means associated with the hole sensing device and arranged to engage the rail on operation of the moving means to position the hole locating device a predetermined distance from the rail as determined by the stop and corresponding to the distance of the tie plate holes from the rail, the member being movable laterally away from the rail on engagement by the stop means on the rail to take up excess travel of the moving means.

According to another aspect of the invention, there is provided a spike driving device for driving spikes through holes in rail tie plates to secure rails to ties, the device comprising a mounting member carrying spike holding means and spike driving means, means for moving the spike holding means laterally towards a rail a fixed distance, stop means associated with the spike holding means and arranged to engage the rail on operation of the moving means to position the spike holder a predetermined distance from the rail, the mounting member being movable laterally away from the rail on engagement by the stop means on the rail to take up excess travel of the moving means.

According to yet another aspect a spike driving system comprises a main frame, a work frame carrying a spike driving head, a spike holder, means for moving the spike holder to a position remote from the driving head to a position below the driving head for driving of a spike held in the holder, and a spike guide tube having one end located adjacent the top of the holder and another end located upwardly of the first end, a spike conveyor mounted on the main frame and including an indexing and spike gripping mechanism, means for moving the work frame between a "down" position and an "up" position in which the upper end of the tube is adjacent the spike gripping mechanism, and means for releasing the spike gripping mechanism to deliver a spike therefrom to the spike holder.

In the system of the present invention the geometry of the total spike feed path is fixed irrespective of X or Y movement. This is effected by mounting a main fixed geometry portion of the spike conveying and orientation system on a main frame of the machine and providing a guide tube which conveys the spikes from the main portion of the spike conveying and orientation system always at the same angle and orientation to the spike setter.

BRIEF DESCRIPTION OF THE DRAWINGS

The invention will now be described in greater detail with reference to the accompanying drawings, in which.

DESCRIPTION OF THE PREFERRED EMBODIMENT

Figure 1:
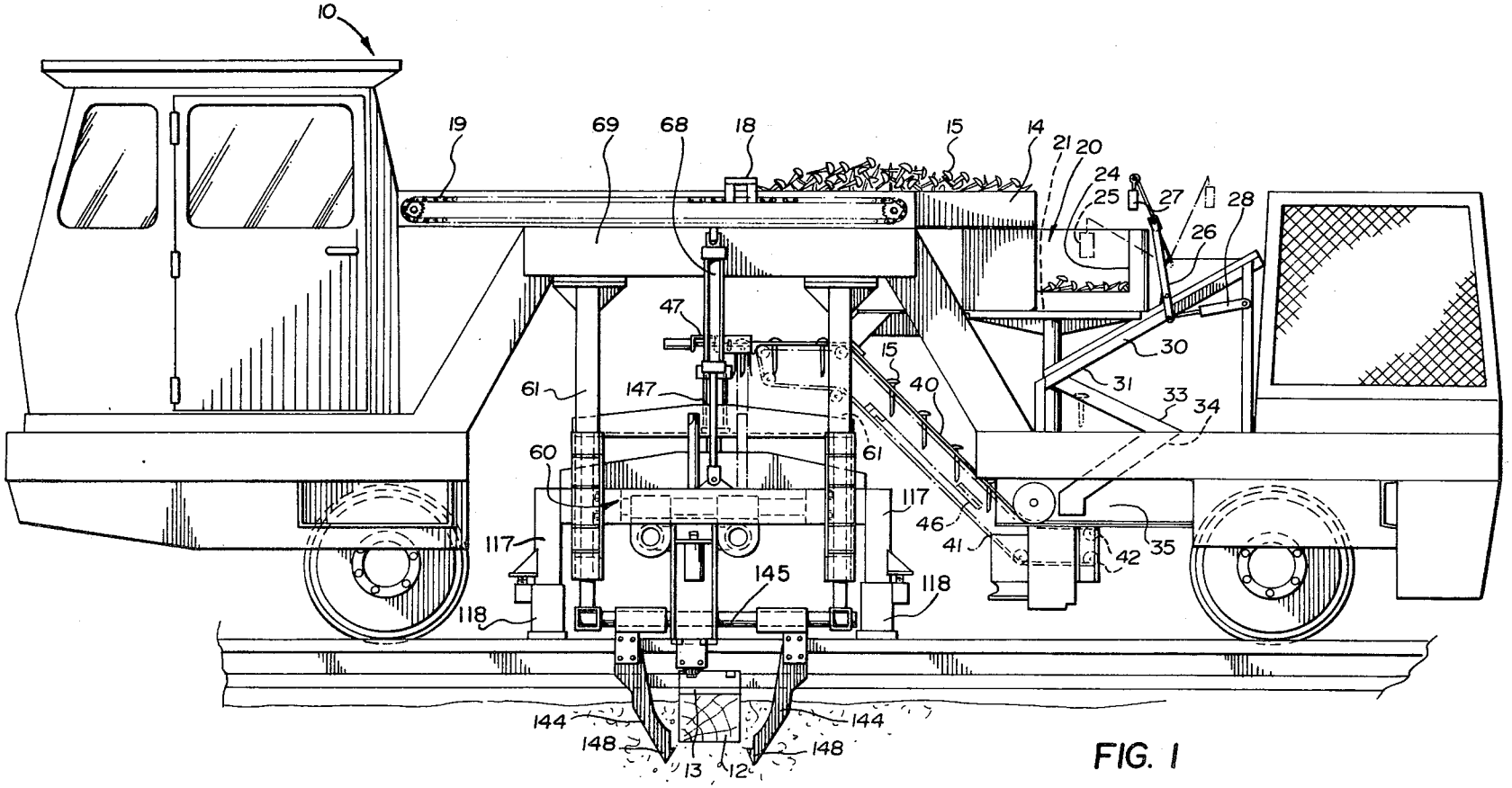
FIG. 1 is a side view of a rail vehicle embodying the spike driver of the invention.

With reference to FIG. 1, a spike driver 10 is formed as a self propelled rail car which travels along rails 11 already positioned in tie plates laid on transverse wooden ties. In the drawing only one tie 12 and one tie plate 13 are shown.

The structure of the spike driver will be described with reference to the rail shown in FIG. 1, it being understood that the structure for the other rail is identical.

The spike driver 10 has a main hopper 14 carrying a load of spikes 15 which will be used for securing the rails 11 to the ties 12 through the agency of the tie plates 13. The hopper 14 is provided with a pusher 18 connected to a drive chain 19 which drives the pusher towards the rear (right hand side as seen in FIG. 1) of the spike driver 10 to push spikes over the rear edge of the main hopper 14 into a further hopper 20 the floor of which is formed as a turntable 21 which serves to disentangle the spikes and spread them individually around the periphery of the hopper 20. Mutual separation of the spikes in this way is essential to proper operation of the spike pick-up mechanism described below. Another feature of the hopper 20 is that the turntable 21 may be forced down under the weight of the spikes against the action of a spring to open a limit switch to de-energize the chain and pusher 18 to ensure an optimum load of spikes in the hopper 20.

The hopper 20 is generally cylindrical and is open at the top and has an access door 24 formed by removing a portion of the peripheral wall 25 at a location towards the rear and outside of the spike driver 10. Mounted adjacent the door 24 is a spike pick-up mechanism. The mechanism comprises essentially a pivotable articulated arm 26 carrying an electromagnet 27 and movable under the action of a pneumatic cylinder 28 to swing the electromagnet into hopper 20 to "grasp" a spike and back out of the hopper 20 and over a sloping guide 30. Limit switches (not shown) control the operation of the cylinder 28 and energization and de-energization of the electromagnet 27 so that the spike adhered to the magnet 27 is swung around and dropped into the guide 30.

The guide 30 forms a portion of a spike orientation system generally designated as 31. The spike orientation system is well known in the art and will not, therefore, be described in detail. Suffice it to say that it serves to ensure that all the spikes dropped by the pick-up mechanism into the guide 30 are oriented with their heads in the same direction. This is important because the spike heads are not perfectly circular but have a radially projecting portion which is adapted to overlie the base of the rail.

As the spikes leave the orientation system 31, they pass along a pair of guide rails 33 by gravity assisted by vibrators attached to the rails to ensure positive feed with the spike shanks lying vertically, the guide rails being provided with a gate shown schematically at 34 which operates to direct the spikes alternately to two storage locations 35, one located inwardly of the rail 11 and the other located outwardly of the rail. There are two storage locations 35 because spikes have to be driven in at both sides of each rail. When the storage locations are full, a limit switch shuts off the orientation system 31, the storage locations being refilled when their levels have dropped below a predetermined value.

The following description will be directed to the structure associated with the driving of spikes at the outside of the rail shown, it being understood that there is identical structure associated with the inside of the rail shown.

Figure 2:
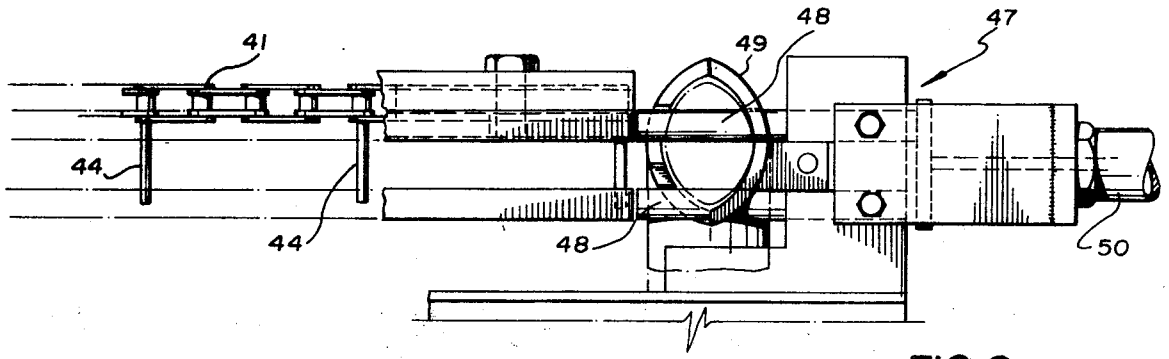
FIG. 2 is an enlarged top view showing a portion of a chain conveyor of the spike driver and a spike gripper mechanism.
Figure 3:
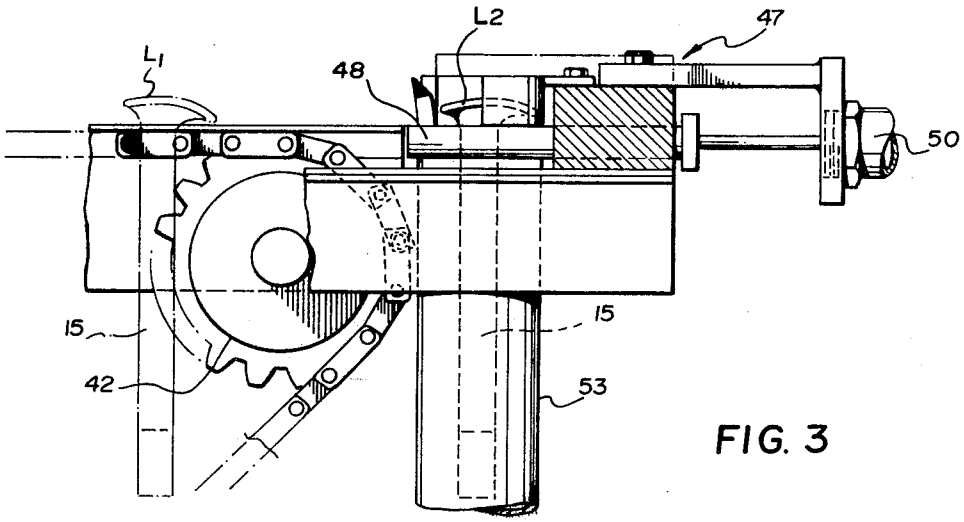
FIG. 3 is a side view of the structure of FIG. 2.

A pair of guide rails 40 extends upwardly and forwardly from the bottom of each storage locations 35 and a drive chain 41, entrained on sprockets 42, is mounted with an upper chain run adjacent the guide rails 40. As best seen in FIG. 2 spaced rods 44 extend transversely from the chain 41 under the guide rails 40. Each rod 44 engages the shank of the lowest spike in the storage location 35 as the chain 41 is driven in a counterclockwise direction to drive that spike upwardly and forwardly to the most forward position of the guide rails 40. The spike orientation system 31 supplies spikes to the storage locations 35 at a higher speed then they are taken from the storage locations 35 by the drive chain 41. Thus there is always a spike ready for pick up by the drive chain, and synchronism of the drive chain 41 and orientation system 31 is rendered unnecesary. Movement of the chain is intermittent and is effected by means of a pneumatic cylinder 46 the stroke of which is equal to the distance between the rods 44 so that as the cylinder 46 is actuated a fresh spike is recieved on the guide rails 40, the spikes already on the rails 40 are indexed forwardly and the leading spike is advanced into a spike gripper mechanism 47 which will be described with particular reference to FIGS. 2 and 3.

The spike gripper mechanism 47 comprises two short rods 48 mounted in close alignment with the foremost end of the guide rails 40. One or both of the rods may be magnetic. The rods are retractable through a back plate 49 by means of a pneumatic cylinder 50. When the chain 41 is indexed the leading spike is propelled by the associated rod 44 forwardly from the position indicated as L1 in FIG. 3, the momentum of the spike being sufficient to carry it from the guide rails 40 on to the rods 48 of the gripper mechanism 47. Swinging of the spike is reduced on engagement thereof with the back plate 49 and swinging is further reduced by the clamping action of the magnetic rod (or rods) 48 thus ensuring that the spike quickly regains a vertical disposition.

Figure 4:
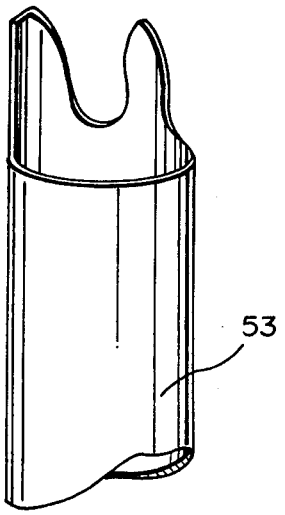
FIGS. 4 and 4a are two enlarged views showing a detail of a spike guide tube of the spike driver.
Figure 4A:
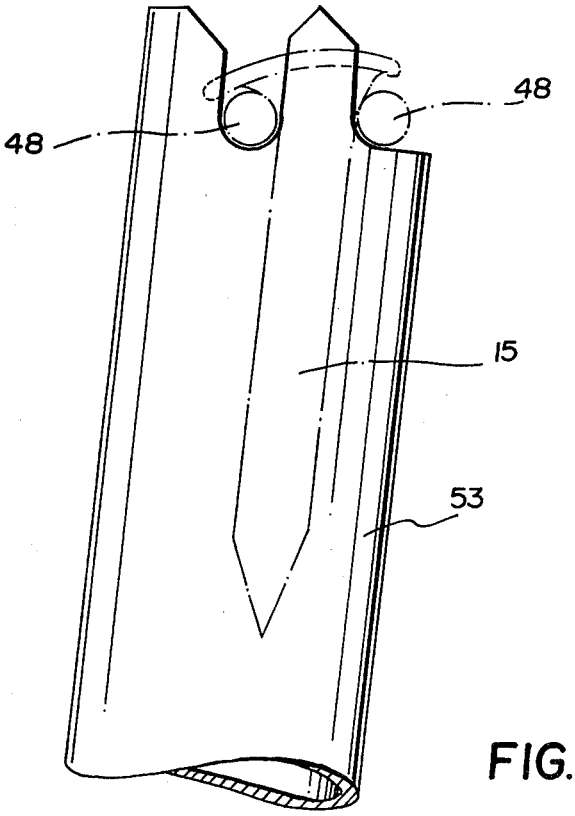

The rods 48 are timed to retract under the action of cylinder 50 after a guide tube 53 has been moved vertically upwards in registry with the shank of the spike gripped in the L2 position. The upper end of guide tube 53 is particularly configured as most clearly seen in FIGS. 4 and 4*a* virtually to surround the entire spike including the head. This ensures that the spike will drop on retraction of the rods 48 in correct alignment and with a minimum of lateral wobble. The purpose of the tube 53 is to guide the spikes 15 successively to a spike setter 57 which, in turn, is adapted to position or "set" successive spikes under a drive head 58, the setter 57 and drive head 58 being clearly shown in FIG. 5. The guide tube 53, setter 57 and drive head 58 are located in a common vertical plane, each being dispoed at the same small angle to the vertical.

Figure 6:
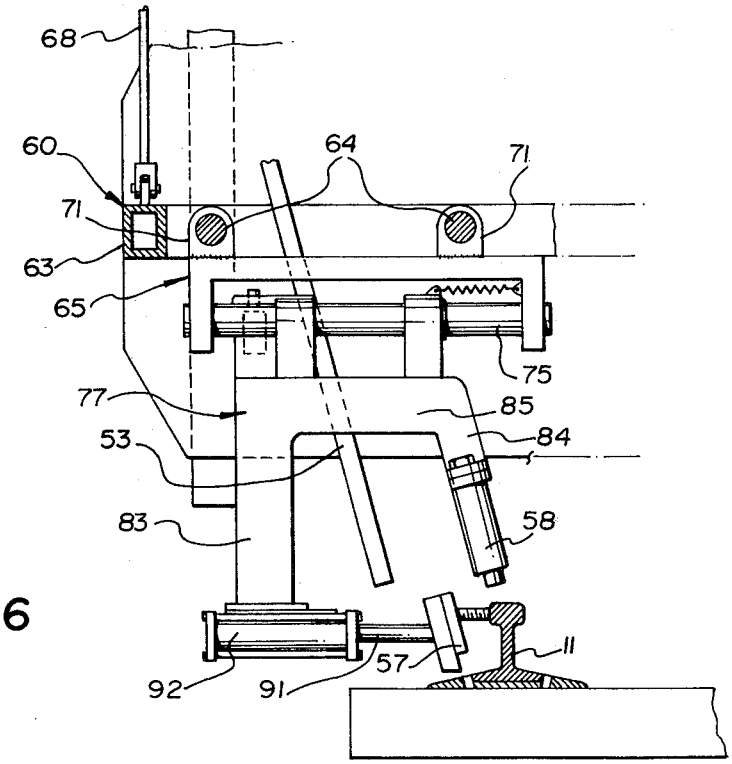
FIGS. 6 and 7 are views similar to FIG. 5 but showing the frames at two successive stages in the operation of the spike driver.
Figure 7:
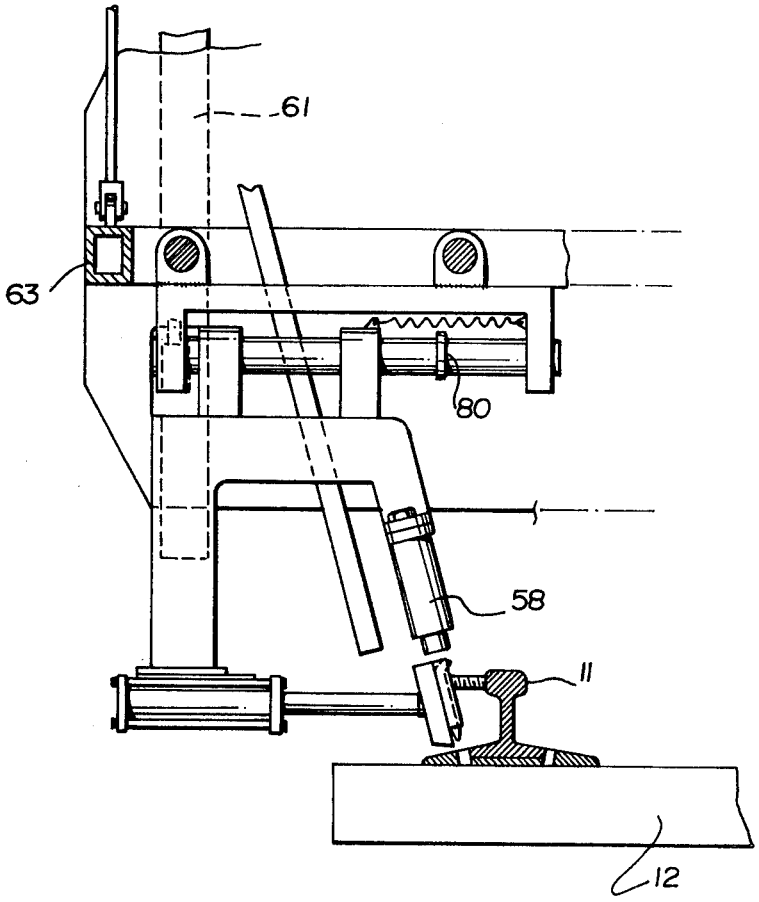
Figure 8:
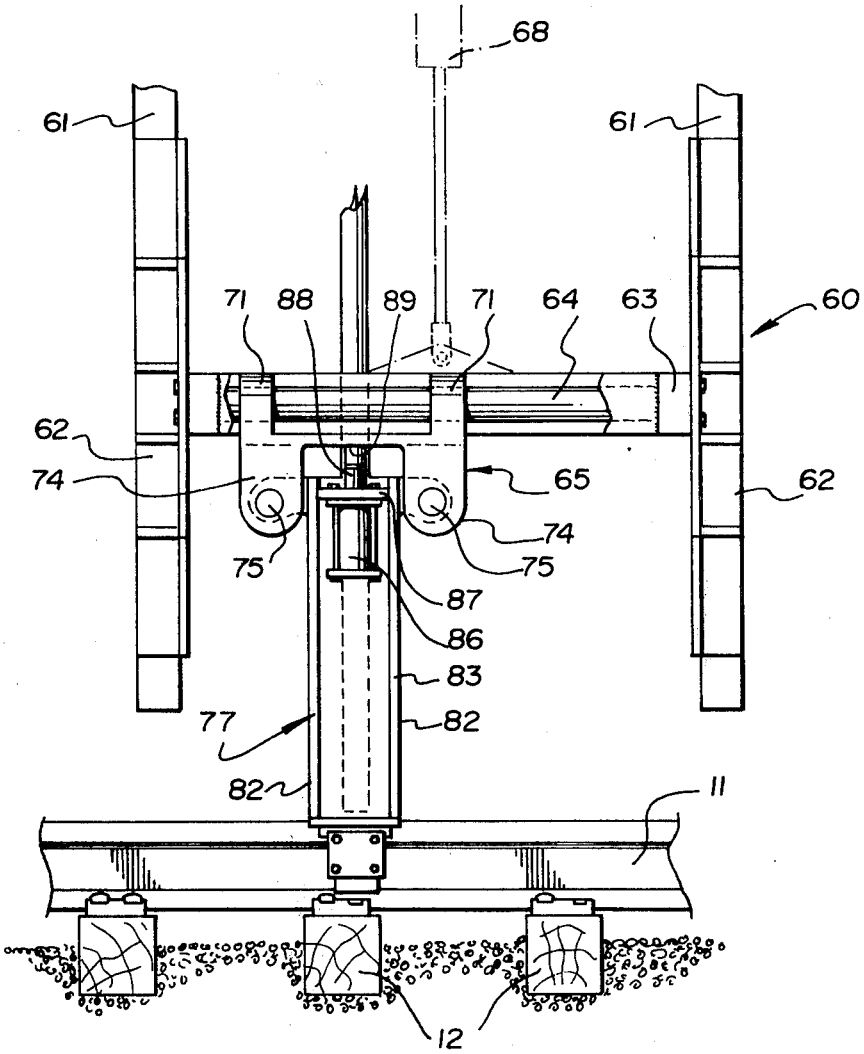
FIG. 8 is an enlarged side view, i.e., looking from the left in FIGS. 5–7, of the frame system of FIG. 5.
Figure 9:
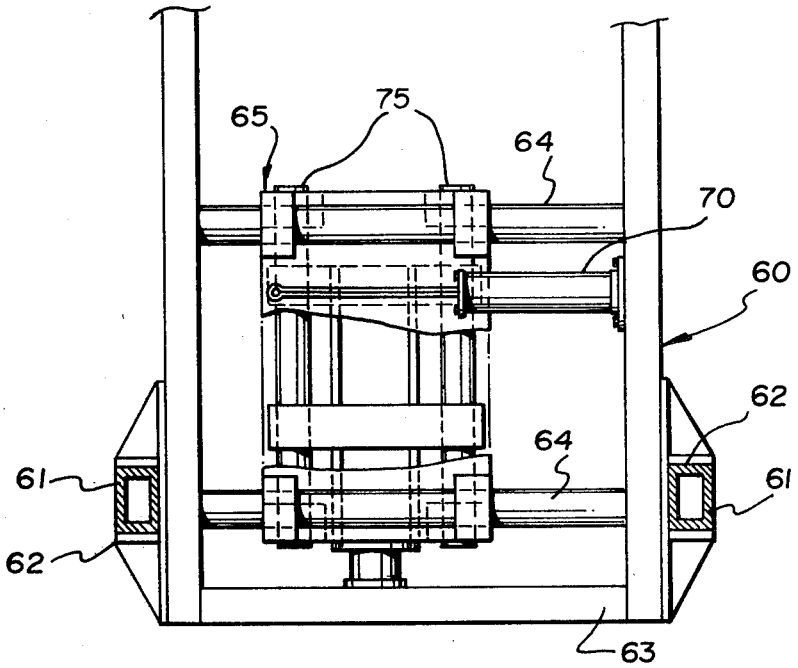
FIG. 9 is an enlarged fragmentary view looking down on the frame system of FIG. 8.

The setter 57 and drive head 58 are supported on a system of frames permitting vertical, lateral (with respect to the rails 11) and longitudinal movement and this system of frames will be described with particular reference to FIG. 1 and FIGS. 5–9. A work frame 60 is vertically movable on two guide beams 61. The work frame 60 is generally H-shaped as seen in FIG. 8 comprising two vertical sleeves 62 received on the beams 61 and a cross member 63. As seen most clearly in FIG. 9 the work frame 60 also carries two spaced rods 64 slidably supporting a Y-frame 65. The work frame 60 is movable vertically under the action of a pneumatic cylinder 68 connected between the cross member 63 and a point on the main frame 69 of the machine.

The Y-frame 65 is capable of limited motion in the Y direction (i.e., along the track) relative to the work frame by sliding on the rods 64 under the action of a pneumatic cylinder 70, four bushings 71 providing the sliding interconnection with the rods 64. The main portion of the Y-frame 65 is suspended below the rods 66 and has two pairs of depending mounting portions 74 supporting two parallel spaced rods 75 extending horizontally beneath the rods 64 and perpendicularly with respect to the rods 64, i.e., rods 75 extend laterally with respect to the rail 11 which is known as the X-direction.

Carried on the Y frame 65 is an X-frame 77 which by virtue of bushings 78 slidably mounted on the rods 75 is capable of limited sliding movement in the X-direction relative to the Y-frame 65. A spring 79 extending between one of the mounting portions 74 (see FIGS. 5–7) and an appropriate bushing 78 biases the X-frame inwardly in the direction of the rail 11 to a position defined by a stop 80 mounted on the rod 75.

The X-frame is suspended by the bushings 78 and comprises essentially two spaced plates 82 weled together to form a channel-like configuration on which are mounted the tube 53, the setter 57 and the drive head 58. The setter 57 is connected to the lower end of an outermost leg portion 83 of the X-frame and the drive head 58 is mounted on the lower end of an inner leg portion 84. The tube 53 is mounted on a central portion 85 of the X-frame. As best seen in FIG. 8, a pneumatic cylinder 86 is mounted vertically between the plates 82 on a tie-piece 87. The piston 88 is tipped with rubber or other high friction material and is adapted on extension to cause the rubber tip to engage with the underside 89 of the Y-frame 65.

The setter 57 is actually mounted on a plate 90 carried on the end of a piston 91 of a pneumatic cylinder 92 mounted on the outer leg 83. Mounted also on the plate 90 on either side of the setter is a hole feeler 94 and an adjustable stop 95 (see FIGS. 14 and 15). The setter 57 is formed as a generally U-shaped open channel, the side walls 97 of which have two opposed holes through which project looped portions 98 of cantilever springs 99 attached to the outsides of walls 97. The base 101 of the setter has a circular magnetic portion 102 located about one third of the way up from the bottom of the setter. At the top of the setter is a spring loaded plate 103 which is pivotally mounted on the lower end of the guide tube 53. The plate 103 has a bent retaining finger 104 which projects partly into the channel of the setter. A U-shaped stop plate 105 is mounted on the inner end of the cylinder 92 so that it is aligned with the opening at the bottom of the guide tube 53. The U of plate 105 is wider than the shanks of the spikes but narrower than the heads of the spikes. The side walls 97 of the setter are stepped at 106 so that the lowest portions 107 of the walls project less than the upper portions 108.

The hole feeler 94 comprises a mechanical finger 112 which is adapted to ride along a tie plate and when it enters a hole to extend slightly then immediately retract to operate a switch in the feeler to indicate the presence of a hole.

The stop 95 is formed as a screw threaded member 113 mounted in a vertical slot 114 in a plate 115 by two nuts 116, one at each face of the plate. Clearly, the member 113 may be adjusted in terms of its height and its length of projection by adjusting the nuts. The free end of the member 113 is intended to engage the "head" 11*a* of the rail 11 and this establishes the minimum spacing of the setter from the rail. To reduce friction a roller may be mounted to the free end of the member for engagement with the head of the rail. The length the member 113 projects must be chosen to ensure that a spike in the setter and also the mechanical finger 112 of the hole feeler are positioned the same distance from the rail head as the tie plate holes and the height of member 113 must be chosen to ensure engagement with the "head" of the rail. The adjustability feature permits use with different sizes of rails.

Also attached to the work frame 60 is a pair of vertical spaced legs 117 ending in adjustable feet 118. The height of the feet is adjustable to provide for different heights of rail so as to maintain the setter at a predetermined distance above the tie plate which distance is seen in FIGS. 5, 6 and 7.

The sequence of steps involving the movement of the various frames will now be described. With the work frame 60 in the up position, the upper end of the guide tube 53 surrounds a spike held in the spike gripper mechanism 47. A limit switch (not shown) operates to retract the rods 48 dropping the spike down the tube 53. The spike is carried by gravity and in the correct orientation into the setter 57 where it is stopped by engagement of the spike head with the stop plate 105. The springs 99 ensure the spike is held centrally in the setter and the finger 104 of plate 103 prevents the spike from "jumping" laterally out of the open end of the setter 53.

Figure 5:
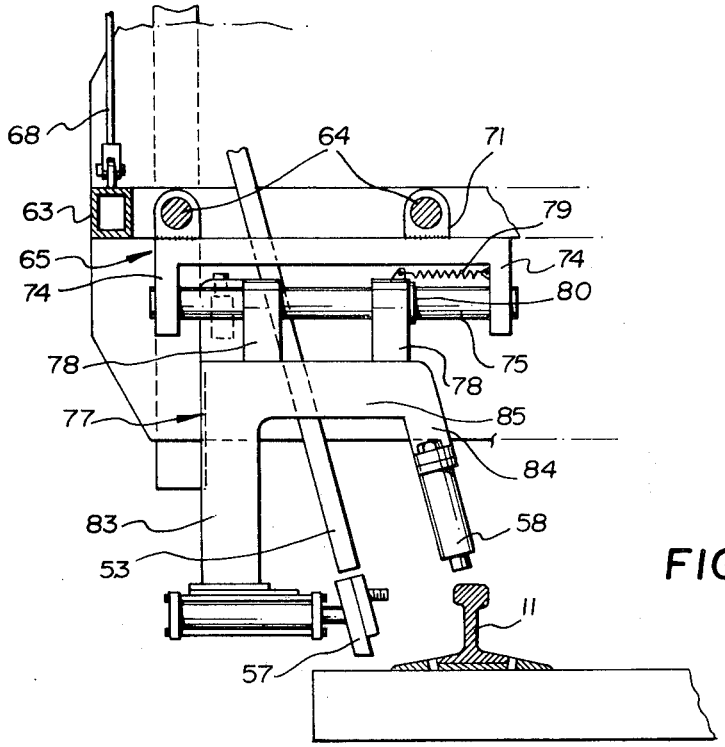
FIG. 5 is an enlarged fragmentary view looking from the rear of the spike driver, i.e., from the right in FIG. 1, and showing a system of frames providing movement in three mutually perpendicular directions.

The work frame 60 is then lowered until the feet 118 rest on the rail and the various frames 60, 65 and 77 assume the positions shown in FIG. 5. The feet provide a stable base from which the spike driving may be performed. The cylinder 92 is then actuated, extending piston 91 until the stop 95 engages the rail 11 which is the position shown in FIG. 6. The piston is not yet in its full stroke position but the setter is the correct distance from the rail 11 as determined by the stop 95. It is noted that as the setter 57 is moved out of alignment with the guide tube 53, the plate 103 is pivoted forwardly and upwardly free of the forward face of the setter 57 allowing the setter to push the spike held in the setter out of the open end of the U in the stop plate 105, the magnet 102 serving to hold the spike in the setter from this point on.

As extension continues to the full stroke position, the piston 91 is unable to move any further to the right and so the cylinder 92 moves to the left. Because the cylinder 92 is mounted on the X-frame 77, the X-frame moves to the left against the action of the spring 79 until the full stroke position is reached. In this position, shown in FIG. 7, the drive head 58 is aligned above the setter 57.

It is clear from the above discussion that, in the retracted position of the piston 91, the setter 57 is a predetermined lateral distance from the drive head 58, which predetermined lateral distance is equal to the stroke of the piston so that when the piston is fully extended to its fixed stroke position, the spike setter and drive head are correctly aligned. The position of the stop 80 is not critical except that it should not be located so far to the left as seen in FIGS. 5–7 as to prevent the stop 95 engaging the rail in the full stroke position of piston 91. The provision of the spring connection between X-frame 77 and the Y-frame 65 permits excess travel of the fixed stroke piston to be taken up.

This arrangement ensures that the spike setter 57 is always aligned under the drive head 58 no matter what the thickness of the rail head.

The Y-frame 65 then sweeps in the Y-direction under the action of pneumatic cylinder 70 (FIG. 9) which is initiated by a limit switch (not shown) detecting full stroke of the piston 91. The finger 112 of the hole feeler 94 traces along the upper surface of the tie plate 13 until it finds a hole in the tie plate at which point it extends into the hole and immediately retracts operating a switch in the hole feeler 94 to indicate the presence of the hole. This operates a Y-reference mechanism described below which references the drive head 58 and setter 57 to the hole position. The Y-frame continues its sweep until the drive head 58 and setter 57 are aligned with the hole as determined by the Y-reference mechanism. With the Y-frame stopped in this position, the drive head 58 is operated and simultaneously the piston 88 is extended to engage the underside of the Y-frame. The head 58 drives the spike in the setter (which is held only by the magnet 102) down through the tie plate hole and into the tie, the engagement of the piston 88 with the Y-frame serving to lock the X-frame relative to the Y frame to prevent any tendency for the X-frame to move laterally under the force of the drive head 58.

Figure 10:
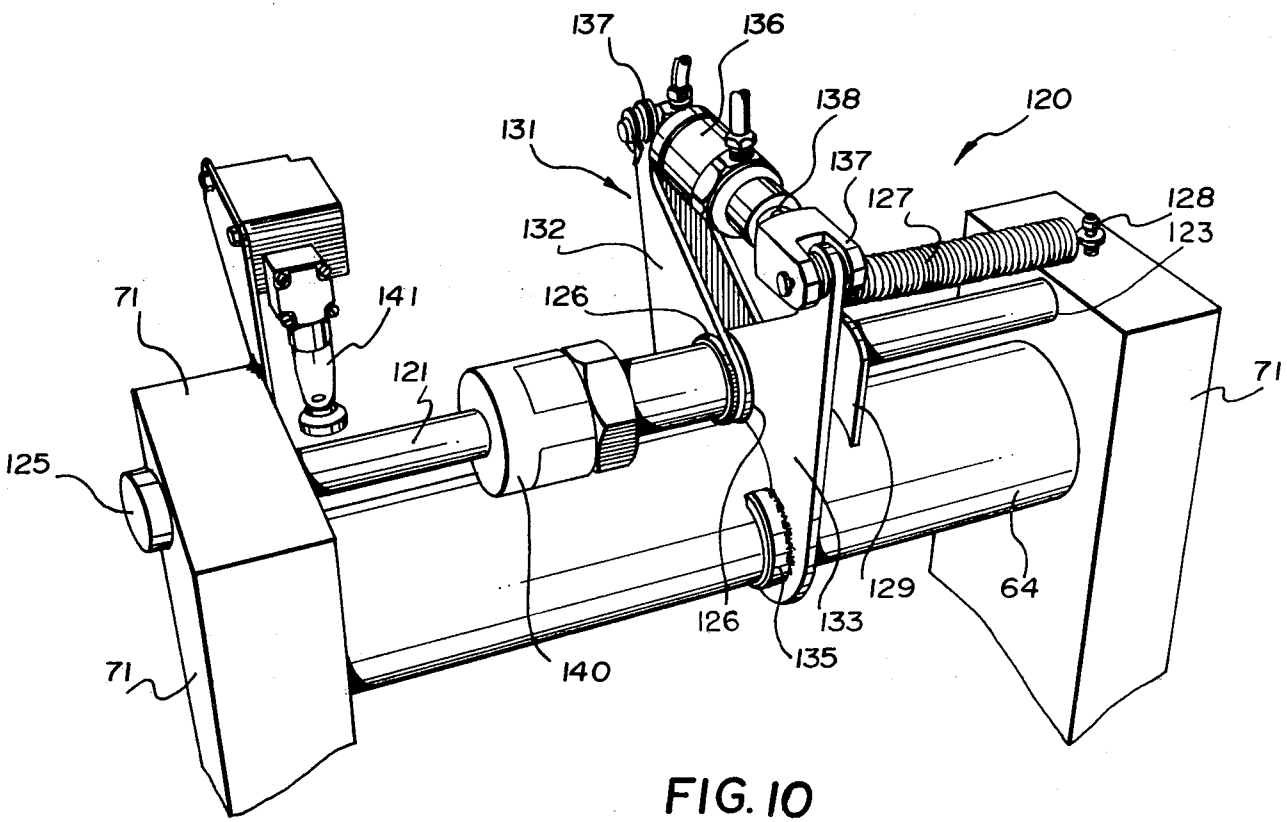
FIG. 10 is an enlarged perspective view of a reference mechanism forming part of the spike driver.

The Y-reference mechanism, referred to above, is generally referenced 120 in FIGS. 10–13. Referring firstly to FIG. 10, the mechanism 120 includes a slim rod 121 which extends parallel to and just above one of the rods 64 along which the Y-frame 65 slides. The rod 121 is received loosely in two holes 123 provided respectively in the bushings 71 of the Y-frame 65. The rod 121 has a head 125 which limits movement of the rod 121 to the right as seen in FIG. 10. A very strong tension spring 127 extends between a screw 128 carried on top of one of the bushings 71 and a plate 129 rigidly mounted on the rod 121. The spring 127 urges the rod 121 to its extreme right hand position, as seen in FIG. 10, in which the head 125 bears against the left hand bushing 71. The right hand end portion of the rod 121 is seen to protrude beyond the right hand bushing.

Approximately centrally, the rod 121 carries a "tongs" arrangement 131 which includes two generally triangular members 132 and 138 extending outwardly from diametrically opposed locations on the rod 121. Both members 132 and 133 are fixed in the longitudinal direction of the rod 121 by suitable locking members 126 but are free to pivot circumferentially with respect to the rod 121 at least over a small arc. As can be seen the member 132 is formed of two spaced plates and the member 133 as a single plate extending from a point between the plates of member 132.

The lower end of each member 132 and 133 carries a similar arcuate gripping pad 135 spaced closely adjacent the circumferential surface of the rod 64 along which the Y-frame slides. The shape of the pads 135 conforms to that of the rod 64. A pneumatic cylinder 136 is mounted between the upper ends of the members 132 and 133, pivotal connections 137 being provided at the interconnections of the cylinder and the member 132 and of the piston 138 and the member 133. It should be appreciated that as the piston 138 moves out of the cylinder 136 the tops of the members 132 and 133 are pushed apart, the members 132 and 133 rotating in opposite senses until the pads 135 grip the rod 64.

The rod 121 also carries an abutment 140 serving as an actuator for a limit switch 141 mounted on the left hand bush 71.

Operation of the Y-reference mechanism 120 will now be described with reference to FIG. 11–13 in which the setter 57, head 58 and hole feeler 94 are shown schematically to indicate their respective positions corresponding to different positions of the Y-reference mechanism.

Figure 11:
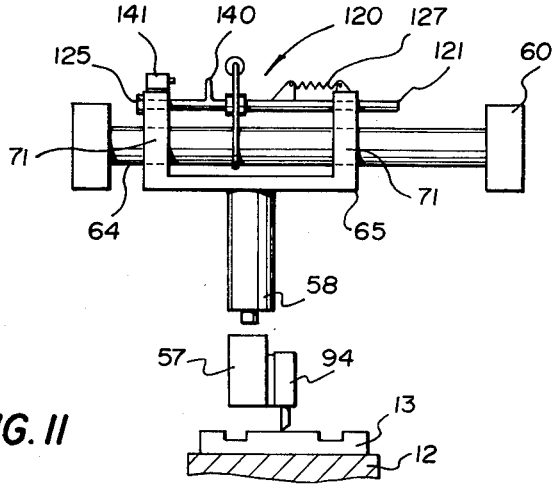
FIGS. 11–13 are 3 diagrammatic views showing the mechanism of FIG. 10 at successive stages of its operation.
Figure 12:
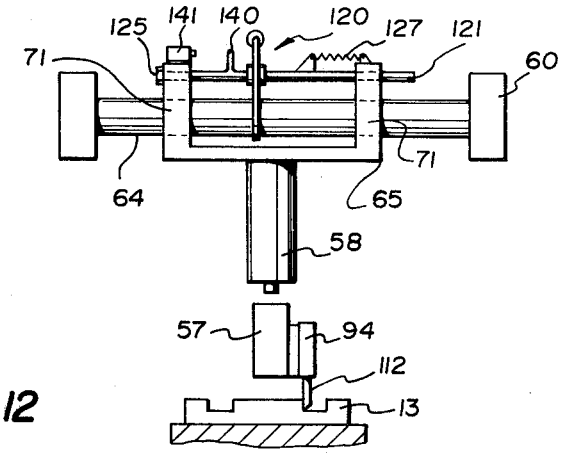
Figure 13:
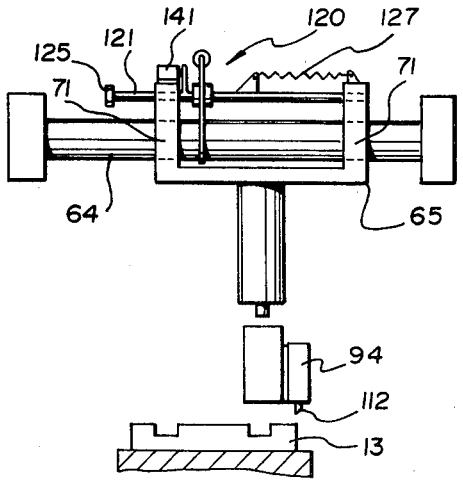

In FIG. 11, the setter piston 91 has been fully extended so that the X-frame 77 is in the position indicated in FIG. 7, and the Y-frame 65 is about to begin its sweep (to the right in FIGS. 11–13).

As the Y-frame moves the feeler 94 engages a hole in the tie plate 13 a little later as shown in FIG. 12. Because of the stiffness of the spring 127, the Y-reference mechanism 120 moves along with the Y-frame 65 without relative movement. As indicated above, the extension and retraction of the finger 112 operates a microswitch. This causes actuation of the cylinder 136 which immediately causes clamping of the gripping pads 135 on the rod 64. The rod 121 is now fixed to the rod 64 and as the Y-frame 65 continues its rightward travel the spring 127 is extended as the limit switch 141 approaches the abutment 140 on the now stationary rod 121 until the position shown in FIG. 13 is reached.

In the FIG. 13 position the switch 141 has just been actuated by the abutment 140 causing de-energization of the cylinder 70 (FIG. 9) driving the Y-frame 65. The Y-frame is now stopped with the setter 57 and drive head 58 aligned over the tie plate hole and the drive head 58 is actuated to drive the spike in the setter into the hole at a small angle to the vertical.

Figure 14:
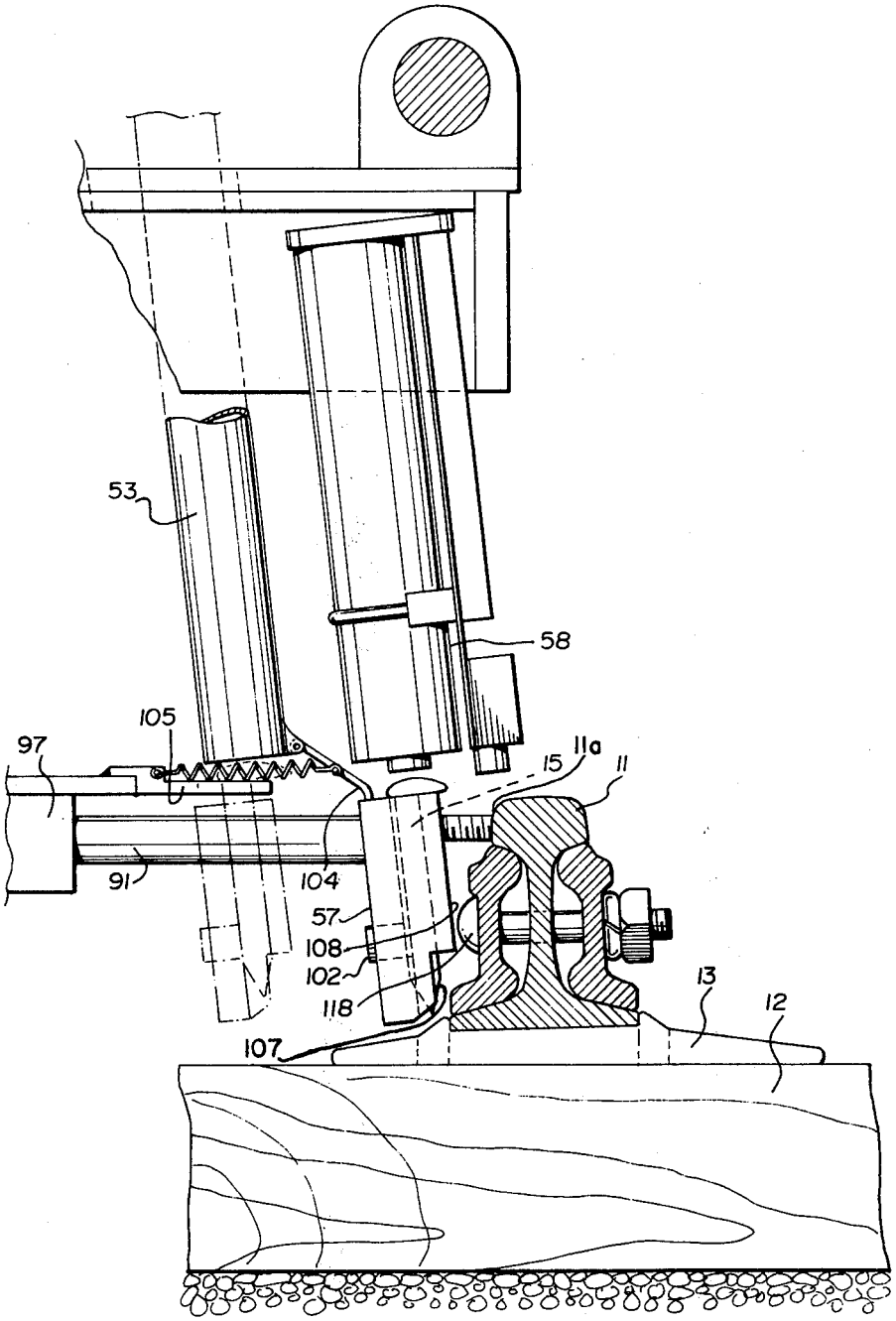
FIG. 14 is an enlarged fragmentary view looking in the same direction as FIG. 5 and showing in detail the shape and configuration of the spike guide tube, setter and drive head.
Figure 15:
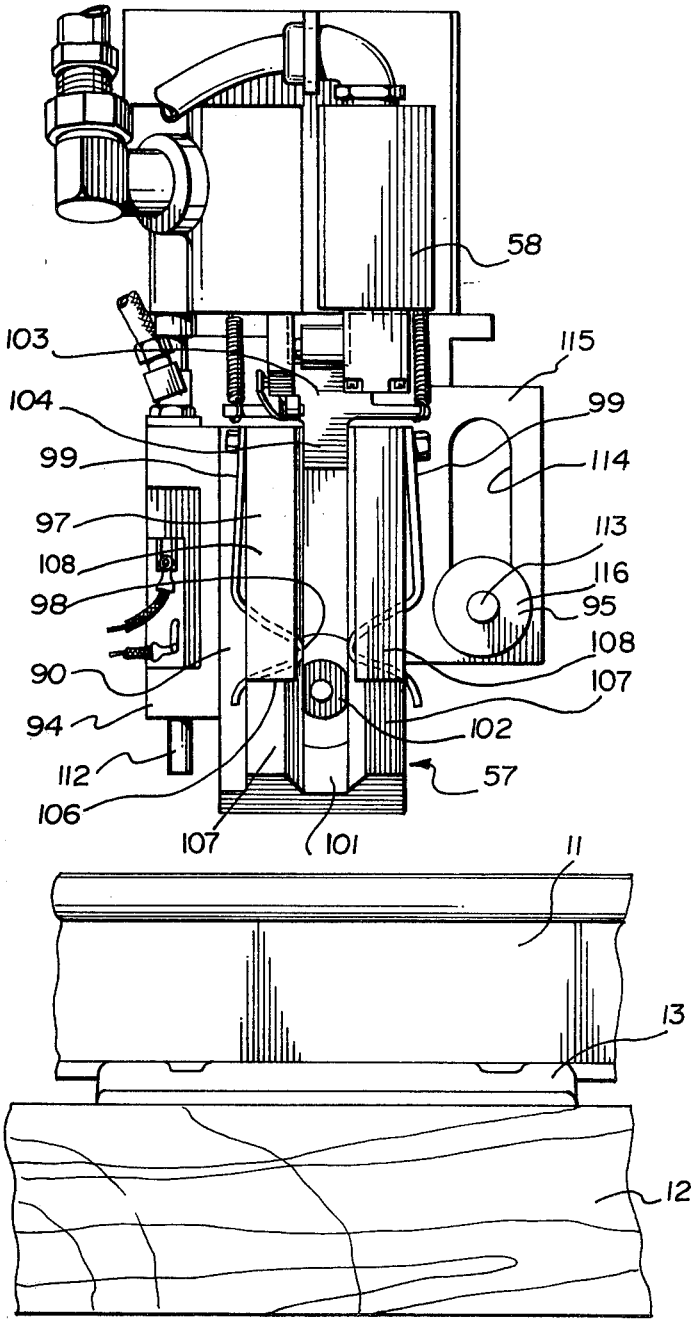
FIG. 15 is a greatly enlarged view looking from right to left of FIG. 14 and showing in detail the configuration of the setter assembly.

The shape and configuration of the setter 57, particularly the open longitudinal face and the small angle at which the setter is disposed, enable the setter to be positioned closely and accurately relative to the hole even at the location of a rail joint bar 118 as seen in FIG. 14.

There is one other aspect of the machine which has not yet been described and this is the means for securing the tie 12 against the force of the drive head 58 as the spike is being rammed through the hole in the tie plate and into the tie. With reference to FIG. 1 this "means" comprises a pair of tie nippers 144 which may be hydraulically moved towards and away from each other on a rod 145. The nippers 144 may also be lowered and raised by means of a hydraulic cylinder 147.

In operation, once the feet 118 of the work frame 160 contact the rail the nippers 144 are lowered one on each side of a tie 12 into the ballast under the tie. When the nippers reach a predetermined depth they then are forced together into contact with the sides of the tie. The nippers 144 are actuated in parallel hydraulically so that the tie will be urged to a position in the vicinity of the setter and attached hole feeler. In the event the tie is immobile in the ballast the closing of the nippers 144 will cause movement of the work frame to assume the correct relative positions of the hole feeler and tie. While the tie is being squeezed by the nippers 144, the nippers are raised, free end portions 148 of the nippers engaging the index side of the tie and holding the tie and tie plate tight against the rail. The reaction of this lift force is transferred back through the work frame feet 118 to the rail. The nippers 144 hold the tie throughout the whole spike driving cycle after which they are retracted in a sequence opposite to the extension sequence except that the nippers 144 are forced downwardly for an instant prior to being moved outwardly to release the tie.

The complete operation of the spike driver will be summarized in the following sequence of events.

1. The spike driver car is positioned on the track such that a tie 12 is located generally centrally below the nippers 144.

2. The work frame 60 is lowered until the feet 118 engage the top of the rail.

3. The nippers 144 are lowered, squeezed together and raised under the tie.

4. The setter 57 is extended in the X-direction to a location between the holes in a tie plate 13.

5. The Y-frame 65 sweeps in the Y-direction towards one of the holes in the tie plate 13.

6. The hole feeler 94 senses the hole and operates the Y-reference mechanism 120.

7. The Y-reference mechanism stops the Y-sweep with the setter 57 and drive head 58 aligned over the hole.

8. The drive head 58 drives the spike from the setter through the hole and into the tie and simultaneously the piston 88 is extended to lock X-frame 77 and Y-frame 65 together.

9. The drive head 58 retracts and the piston 88 is simultaneously retracted.

10. The indexing cylinder 46 operates to index the spikes on the conveyor chain 41 and propel the leading spike into the gripper mechanism 47.

11. The nippers 144 are then moved downwardly and outwardly.

12. The setter 57 is retracted away from the rail 11.

13. The nippers 144 are raised.

14. The Y-frame 65 sweeps back to the start position.

15. The work frame 60 is raised, the guide tube 53 registering with the spike held in the gripper mechanism 47.

16. The gripper mechanism 47 releases the spike which is caught in the setter 57.

17. The spike driver car is moved to the next tie 12 where the operation is repeated.

What is claimed is:

1. A device for applying fastening members to rail tie plates to secure rails to ties, the device comprising a first mounting member carrying predetermined stroke means and driving means for driving a fastening member, fastening member holding means secured to the predetermined stroke means, said predetermined stroke means being operable for moving the holding means laterally towards a rail from a fully retracted position to a full stroke position, the lateral distance between the holding means in the retracted position and the driving head being equal to the stroke of the predetermined stroke means, stop means rigidly connected with the holding means and engagable with the rail on operation of the predetermined stroke means to position the holding means a predetermined distance from the rail, a second mounting member fixed against movement laterally relative to the rail, the first mounting member being mounted on the second mounting member for movement laterally relative to the rail, and resilient means interconnecting the first and second mounting members and biasing the first mounting member towards the rail to an inner biased position, whereby the mounting member moves laterally away from the rail to an outer position against the biasing action of the resilient means on engagement by the stop means with the rail to take up excess travel of the predetermined stroke means and position the driving head over the holding means.

2. The device of claim 1 further comprising braking means on one of said mounting members and engaging the other mounting member and operable after completion of movement of the first mounting member away from the rail to prevent further relative movement between the first mounting member and the second mounting member.

3. The device of claim 2, in which the braking means comprises a power cylinder having a piston and mounted on the first mounting means, the cylinder being operable to extend said piston into engagement with the second mounting member.

4. The device of claim 2 further comprising means for operating and braking means during operation of the drive head.

5. The device of claim 1, further comprising a third mounting member on which the first and second mounting members are mounted for conjoint movement relative to the third mounting member in a direction parallel to the rail.

6. The device of claim 5 in which the third mounting member is movably mounted on the device for relative movement in a vertical plane.

7. The device of claim 6, in which the holder comprises means for holding a spike and the driving head comprises means for driving the spike through a hole in a tie plate into a tie, and further comprising a spike conveyor on the device, a spike gripping mechanism located at a fixed point adjacent said conveyor to which said conveyor delivers spikes, a guide tube on said first member, the guide tube having a lower spike outlet adjacent the spike holder prior to movement of the spike holder toward the rail, and the guide tube having an upper spike inlet which in the raised position of the third member is presented to the spike gripping mechanism for transfer via the tube of a spike from the spike gripping mechanism to the spike holder.

8. The device of claim 1 further comprising a hole locating device mounted on the fastening member holder.

9. The device of claim 1, in which the stop means is adjustable on said holding means to vary the distance of the fastening member holder from the rail.

10. The device of claim 1 in which the fastening member holding means comprises a generally V-shaped channel member having two open ends, one through which a fastening member is delivered to the channel member and the other through which the fastening member is driven from the channel member by the fastening member driving means, the channel member having an open longitudinal face directed towards the rail and fastening member retaining means operatively associated with said channel member for releasably holding the spike in the channel member.

11. The device of claim 16 in which the channel member has a longitudinal axis disposed at a small angle to the vertical.

12. The device of claim 11 in which the open longitudinal face is stepped such that a lower portion of the channel member projects less towards the rail than does the remainder of the channel member.

13. The device of claim 1 further comprising hopper means as said device for carrying a supply of spikes, and conveyor means on said device for conveying in a predetermined orientation fastening members from the hopper means to the fastening member holding means, the hopper means comprising a main hopper for carrying the bulk of the fastening members and having means for pushing the fastening members out of said hopper means, a further hopper having a floor which is a turntable for disentangling the fastening members, and means on said device for individually transferring the fastening members on the turntable into the conveyor means.

14. The device of claim 13 further comprising a weight responsive switch associated with the turntable and connected with the means for pushing the fastening members for energizing the pushing means when the weight of the turntable and fastening members on the turntable is less than a predetermined value and de-energized when the weight is greater than the predetermined value.

15. The device of claim 1 in which the holding means comprises means for holding a spike and the driving means is arranged to drive the spike through a hole in a tie plate into a tie.

16. In a system for applying fastening members to rail tie plates to secure rails to ties, a hole locating mechanism comprising a first mounting member, predetermined stroke means mounted on the first mounting member and a hole sensing device carried thereon, said stroke means being operable for moving the hole sensing device laterally towards a rail, stop means rigidly connected with the hole sensing device and engagable with the rail on operation of the predetermined stroke means to position the hole locating device a predetermined distance from the rail as determined by the stop and corresponding to the distance from the rail of holes in the tie plate from the rail, a second mounting member fixed against movement laterally relative to the rail, the first mounting member being mounted on the second mounting member for movement laterally relative to the rail and resilient means interconnecting the first and second mounting members and biased position, whereby the mounting member moves laterally away from the rail against the biasing action of the resilient means to an outer position on engagement by the stop means on the rail to take up excess travel of the predetermined stroke means.

17. The hole locating mechanism of claim 16 in which the means for moving the hole sensing device is a fixed stroke piston and cylinder.

18. The hole locating mechanism of claim 16 further comprising a third member on which the member carrying the hole sensing device and the second member are mounted for movement relative to the third member parallel to the rail.

19. A spike driving machine for driving spikes through holes in rail tie plates to secure rails to ties, the machine comprising a work frame, means connected to said work frame for moving the work frame vertically between a raised position and a lowered position, a Y-frame mounted on the work frame and movable relative thereto in a direction parallel to a rail, means connected to said Y-frame for moving the Y-frame parallel to the rail, an X-frame mounted on the Y-frame and movable relative thereto in a direction transversely of the rail, spring means interconnecting the Y-frame and the X-frame so as to urge the X-frame transversely towards the rail, a spike driving head mounted on the X-frame, a spike setter mounted on the X-frame, a hole locating device associated with the setter, fixed stroke means mounted on the X-frame for urging the spike setter under the driving head and urging the hole locating device to a position adjacent the setter, stop means on said stroke means and engageable with the rail to position the spike holder, driving head and hole locating device in the correct location in a direction transversely of the rail for alignment with the plate holes.

20. A spike driving system comprising a main frame, a work frame carrying a spike driving head, a spike holder, means on which said spike holer is mounted for moving the spike holder from a position remote from the driving head to a position below the driving head for driving of a spike held in the holder, and a spike guide tube having one end located adjacent the top of the holder and another end located upwardly of the first end, a spike conveyor mounted on the main frame and including an indexing and spike gripping mechanism, means for moving the work frame between a "down" position and an "up" position in which the upper end of the tube is adjacent the spike gripping mechanism, and means operatively connected to said gripping mechanism for causing the spike gripping mechanism to release a spike and deliver it from the spike gripping mechanism to the spike holder.

* * * * *